US008939219B2

(12) United States Patent
Taskinen et al.

(10) Patent No.: US 8,939,219 B2
(45) Date of Patent: Jan. 27, 2015

(54) SYSTEM AND METHOD FOR MONITORING AND CONTROLLING SNUBBING SLIPS

(75) Inventors: John Taskinen, Nisku (CA); Troy Leblanc, Nisku (CA); Shawn McKinnon, Nisku (CA); Lance Thornell, Nisku (CA)

(73) Assignee: Snubco Manufacturing Inc., Nisku, Alberta (CA)

( * ) Notice: Subject to any disclaimer, the term of this patent is extended or adjusted under 35 U.S.C. 154(b) by 306 days.

(21) Appl. No.: 13/462,446

(22) Filed: May 2, 2012

(65) Prior Publication Data

US 2012/0279726 A1 Nov. 8, 2012

(30) Foreign Application Priority Data

May 5, 2011 (CA) ..... 2739280

(51) Int. Cl.

| | |
|---|---|
| ***E21B 19/086*** | (2006.01) |
| ***E21B 19/18*** | (2006.01) |
| ***E21B 19/16*** | (2006.01) |
| ***E21B 44/00*** | (2006.01) |
| ***E21B 47/00*** | (2012.01) |
| ***E21B 19/07*** | (2006.01) |
| ***E21B 19/10*** | (2006.01) |

(52) U.S. Cl.

CPC ..... *E21B 19/16* (2013.01); *E21B 44/00* (2013.01); *E21B 47/00* (2013.01); *E21B 19/07* (2013.01); *E21B 19/10* (2013.01)

USPC ..... 166/380; 166/255.1; 166/77.53; 166/77.4

(58) Field of Classification Search

CPC ..... E21B 19/086; E21B 19/10; E21B 19/166; E21B 44/02

USPC ..... 166/255.1, 380, 66, 77.53, 77.1, 77.4

See application file for complete search history.

(56) References Cited

U.S. PATENT DOCUMENTS

| | | | | |
|---|---|---|---|---|
| 2,705,614 | A | 4/1955 | McKibben et al. | |
| 3,626,919 | A | 12/1971 | MacMillan | |
| 4,384,612 | A | 5/1983 | Bradford et al. | |
| 4,676,312 | A * | 6/1987 | Mosing et al. | 166/77.53 |
| 4,964,462 | A | 10/1990 | Smith | |
| 5,444,203 | A | 8/1995 | Gunnarsson | |
| 5,791,410 | A * | 8/1998 | Castille et al. | 166/77.1 |
| 5,988,274 | A * | 11/1999 | Funk | 166/77.4 |
| 6,591,916 | B1 * | 7/2003 | Ayling | 166/380 |
| 6,688,393 | B2 * | 2/2004 | Sredensek et al. | 166/377 |
| 7,028,586 | B2 * | 4/2006 | Robichaux | 81/57.34 |
| 7,086,461 | B2 * | 8/2006 | Schulze-Beckinghausen et al. | 166/77.53 |
| 7,252,151 | B2 * | 8/2007 | Ayling | 166/380 |
| 7,487,839 | B2 | 2/2009 | Boscher et al. | |

(Continued)

FOREIGN PATENT DOCUMENTS

| | | |
|---|---|---|
| JP | H05212597 | 8/1993 |
| WO | 2004048844 | 6/2004 |

*Primary Examiner* — Jennifer H Gay

(74) *Attorney, Agent, or Firm* — Bennett Jones LLP

(57) ABSTRACT

A system and method for monitoring and controlling a snubbing unit having traveling slips and stationary slips are provided. Position sensors are associated with the slips for detecting opened and closed positions of the slips. Load sensors are associated with the slips for detecting load status of the slips. A control system receives input signals from the sensors, and confirms that either the traveling slips or the stationary slips are loaded before releasing or allowing the release the opposing set of slips, when transferring the pipe string load from the one set of slips to the other set of slips.

14 Claims, 4 Drawing Sheets

(56) References Cited

U.S. PATENT DOCUMENTS

| | | | | |
|---|---|---|---|---|
| 7,866,403 | B1 * | 1/2011 | Borgstadt | 166/379 |
| 8,376,041 | B2 * | 2/2013 | Shampine et al. | 166/77.1 |
| 8,517,090 | B2 * | 8/2013 | Haugen | 166/85.1 |
| 8,640,767 | B2 * | 2/2014 | Tucken | 166/77.4 |
| 2003/0075023 | A1 * | 4/2003 | Robichaux | 81/57.37 |
| 2003/0234101 | A1 * | 12/2003 | Ayling | 166/77.53 |
| 2004/0188098 | A1 * | 9/2004 | Schulze-Beckinghausen et al. | 166/380 |
| 2006/0201684 | A1 | 9/2006 | Boscher et al. | |
| 2009/0308603 | A1 * | 12/2009 | Borgstadt | 166/250.15 |
| 2010/0193179 | A1 * | 8/2010 | Tucken | 166/77.1 |
| 2010/0326653 | A1 * | 12/2010 | Borgstadt | 166/250.01 |
| 2011/0017474 | A1 * | 1/2011 | Pietras et al. | 166/380 |
| 2012/0031627 | A1 * | 2/2012 | Sonnier | 166/379 |
| 2012/0279726 | A1 * | 11/2012 | Taskinen et al. | 166/382 |
| 2013/0133900 | A1 * | 5/2013 | Sredensek | 166/380 |
| 2013/0255969 | A1 * | 10/2013 | Olsen et al. | 166/382 |

* cited by examiner

SYSTEM AND METHOD FOR MONITORING AND CONTROLLING SNUBBING SLIPS

FIELD OF THE INVENTION

The present invention relates to a system and method for monitoring and controlling engagement and load transfer of load bearing components in well intervention, completion, drilling, and workover equipment, and snubbing units in particular.

BACKGROUND OF THE INVENTION

Well intervention, completion and drilling equipment are used to feed pipe into and out of subterranean wells. As an example, snubbing units are known in the oil and gas industry for facilitating access to a well which is under pressure. A snubbing unit manipulates various tubular components such as pipe, tubing, and bottomhole assemblies into and out of a well while controlling the well under pressure. A conventional snubbing unit includes stationary and traveling slips which are operated sequentially to shift tubulars into and out of the well through a wellhead, despite the possibility of heavy tubular loads which urge the tubulars to fall into the well ("pipe heavy"), or the reservoir pressure-generated forces on the tubulars, which urge the tubular out of the well ("pipe light").

While snubbing into or out of the well, a transition or "balance point" occurs between pipe light and pipe heavy, where the pipe weight and the lift force exerted by the well acting on the cross-sectional area of the pipe string is substantially equal. Subsequently, hundreds of feet of pipe can be moved with minimal effort.

Snubbing is conventionally controlled manually by an operator, who activates the traveling and stationary slips in sequence when snubbing into or out of a well. The snubbing slips are load bearing components and rely on friction to restrain the tubulars or pipe string. However, it is not uncommon for an operator to release one set of load bearing components accidentally, before transferring the load to the other set of load bearing components. Such an error may result in the pipe string being dropped or ejected, placing personnel at risk and damaging equipment.

Therefore, there is a need in the art for a method and system which mitigates the difficulties of the prior art.

SUMMARY OF THE INVENTION

The present invention is directed to a system and method for monitoring and controlling engagement and load transfer of load bearing components in well intervention, completion, drilling, and workover equipment. Without limitation, in one embodiment, the equipment comprises a snubbing unit.

In one aspect, the invention comprises a system for monitoring and controlling a service unit having first and second load bearing components operating in tandem to engage and move pipe into or out of a well, the system comprising:

a) a first actuation sensor associated with the first load bearing component and a second actuation sensor associated with the second load bearing component, wherein the actuation sensors directly or indirectly detect engagement of the load bearing component on a pipe; and b) a control system operatively connected to the first and second actuation sensors and adapted to receive input signals from the sensors, and configured to execute a method comprising the step of confirming that either the first or second load bearing components have engaged the pipe, before fully releasing, or allowing the full release of the opposing load bearing component, when transferring the pipe string load from one load bearing component to the other. In one embodiment, the service unit is a snubbing unit, and the first and second load bearing components comprise stationary slips and traveling slips.

In one embodiment, the first and second actuation sensors each comprises a position sensor which determines the position of the slip, wherein the slip may move between first position engaging the pipe, and a second position disengaging the pipe. In another embodiment, the first and second actuation sensors each comprise a load sensor which determines the load status of the slip. If the slip is loaded, that indicates the slip has engaged the pipe. Conversely, if the slip is unloaded, the slip has not engaged the pipe. Preferably, the system comprises both a position sensor and a load sensor for each set of slips.

The control system is adapted to process the input signals to provide measures of position and load status and comparing the measures to predetermined values, wherein the positions and load status of the traveling slips or the stationary slips are confirmed if the measures are equal to the predetermined values.

In one embodiment, the position sensor detects the position of a moving part of a slip, or a position of a hydraulic cylinder rod which actuates the slip. In one embodiment, the position sensor comprises a flow meter which measures the flow of a hydraulic fluid used to energize a hydraulic cylinder.

In one embodiment, the load sensor comprises an air bladder, a hydraulic bladder, an electronic load cell, a hydraulic load cell, or a strain gauge. In one embodiment, the load sensor further comprises a pressure transducer.

In another aspect, the invention comprises a method of running pipe with a service unit having first and second load bearing components, operating in tandem to move pipe into or out of a well bore, comprising the steps of:

a) engaging the pipe with a first load bearing component, and moving a second load bearing component to a first position;

(c) engaging the pipe with the second load bearing component;

(d) confirming that the second load bearing component has adequately engaged the pipe before completely releasing the first load bearing component;

(e) moving the second load bearing component to a second position to move pipe either into or out of a wellbore.

In one embodiment, the service unit is a snubbing unit, and the first and second load bearing components comprise traveling slips and stationary slips. In one embodiment, the step of confirming slip engagement with the pipe comprises a step of confirming that the slips have reached a closed position, or determining whether or not the slips are bearing a substantial load, or both.

In one embodiment of the method, at least step (d) is automated to prevent complete release of the first slips without confirmation that the second slips have adequately engaged the pipe. The term "automated" means that a system, without any operator intervention, prevents release of the stationary slips, without the necessary confirmation.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention as defined by the appended claims, will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

Figure 1A:
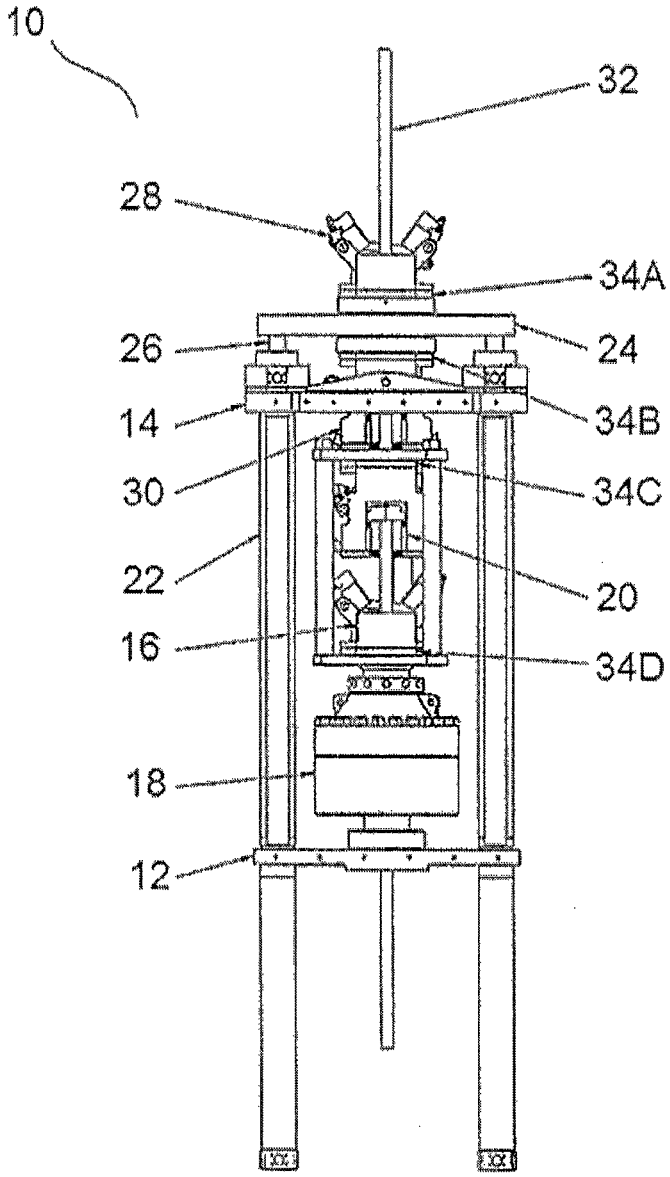
FIG. 1A is a schematic diagram showing an elevational view of a pipe snubbing unit.

The present invention is directed to a system and method for monitoring and controlling engagement and load transfer of load bearing components in well intervention, completion, drilling, and workover equipment. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

One embodiment of the invention is described in the context of control of hydraulic snubbing units. As used herein, the term "hydraulic snubbing unit" means a hydraulically actuated unit including slips, a blowout preventer stack, and hydraulic jacks for inserting or pulling pipe strings, or tubing, and bottomhole assemblies from underbalanced or live well conditions. In the hydraulic jacks, hydraulic pressures act on cylinders to produce a force which is transmitted to the pipe string so that the snubbing unit performs the operation of pushing pipe into or pulling pipe from a well. Traveling slips transmit the lifting or snubbing force from the hydraulic jack to the pipe string. However, it will be understood by one skilled in the art that the method and system described herein may be applied to any well intervention, completion, drilling or workover equipment that utilizes load bearing components that work in tandem to push pipe into or pull pipe from a wellbore, referred to herein as a "service unit".

As used herein, the term "slip" means a load bearing component that comprises a gripping element (for example, a wedge-shaped piece of metal with teeth) used to hold the pipe string in place. Typically, several opposing sets of slips are included in a conventional snubbing unit, with particular slip sets being designated for "pipe heavy" and "pipe light" operations. Conventionally, the slips are "directional" in that they are configured to better resist movement of the pipe in one direction. Stationary heavy slips may be mounted on the blowout preventer (BOP) stack and control the movement of heavy pipe. Traveling heavy slips are conventionally attached to the top of a jack plate and control the movement of heavy pipe. Stationary snubbing slips are conventionally mounted on top of the BOP stack and hold tubing which is in a pipe light or neutral state. Traveling snubbing slips may be mounted in reverse orientation on a traveling jack plate and control the movement of the pipe string into or from the well. The traveling snubbing slips typically hold tubing only when tubing is in the pipe light state.

The elements of the service unit or snubbing unit which are used to actuate the load bearing components, and other conventional elements of such units, are not part of the claimed invention. For example, embodiments of the present invention may be implemented in service units having rack and pinion actuation instead of hydraulic cylinder actuation of the traveling components. The operation of a conventional hydraulic snubbing units is commonly known to those skilled in the art and need not be described in detail herein.

In one embodiment, a snubbing unit (10) comprises a bottom jack plate (12) and a top jack plate (14). The snubbing unit (10) has a stationary heavy slip bowl (16), provided with an underlying blowout preventer (BOP) (18), a stationary snubbing slip bowl (20), and a number of hydraulic cylinder jacks (22) for moving a traveling jack plate (24) vertically towards and away from the top jack plate (14). The hydraulic cylinder jacks (22) each comprise a hydraulic cylinder from which extends a cylinder rod (26), the hydraulic cylinder being mounted between the bottom jack plate (12) and the top jack plate (14), and the uppermost end of the cylinder rod (26) being connected to a traveling jack plate (24). The traveling heavy slip bowl (28) and the traveling snubbing slip bowl (30) are mounted to the traveling jack plate (24). The pipe (32) for snubbing passes through the traveling slip bowls (28, 30), the stationary slip bowls (16, 20) and the BOP (18) as it continues downward into the wellbore (not shown).

The present invention relates to a system and method for monitoring engagement status of load bearing components in a service unit. In one embodiment, the system and method further controls or directs actuation of the load bearing components to reduce the risk of dropping or ejecting the pipe string. In general terms, the system and method provide confirmation to the control system and/or operator that slips have closed and engaged the pipe, and thus have actually been loaded with pipe. With this information, the control system and/or operator will then allow the opposing set of slips to fully release the load to the loaded slips. In addition, the system and method may provide confirmation that a set of slips have released its load.

In one embodiment, the invention comprises a system for monitoring and controlling a service unit having first and second load bearing components operating in tandem to engage and move pipe into or out of a well, the system comprising:

a) a first actuation sensor associated with the first load bearing component and a second actuation sensor associated with the second load bearing component, wherein the actuation sensors directly or indirectly detect engagement of the load bearing component on a pipe; and b) a control system operatively connected to the first and second actuation sensors and adapted to receive input signals from the sensors, and configured to execute a method comprising the step of confirming that either the first or second load bearing components have engaged the pipe, before fully releasing, or allowing the full release of the opposing load bearing component, when transferring the pipe string load from one load bearing component to the other.

In one embodiment, the first and second slip actuation sensors each comprise a position sensor which determines the position of the slip. In another embodiment, the first and second slip actuation sensors each comprise a load sensor which determines the load status of the slip. The presence of load on the slip is indirect confirmation that the slip has engaged the pipe. Preferably, the system comprises both a position sensor and a load sensor for each set of slips.

In one embodiment, the position and load sensors detect position of the slips and load on the slips, respectively, and each generate signals representative of these parameters, and are operatively connected to gauges or indicators which are visible to the service unit operator, and which may also be associated to visual, audible or tactile alarms which alert the operator to condition that requires attention. In another embodiment, the position and load sensors transmit the signals to a control system (100). The control system comprises an interface (110), a memory (120), and a processor (130). The interface (110) may be a conventional interface that is used to receive and transmit data for a controller, such as a micro-controller. The interface (110) is configured to receive signals from the position and load sensors.

The interface may be a conventional device for transmitting and receiving data and may include multiple ports for transmitting and receiving data. The ports may be conventional receptacles for communicating data via various means such as, a portable memory device, a PC or portable computer or a communications network. The interface (110) is coupled to the memory (120) and the processor (130).

The memory may be a conventional memory typically located within a microcontroller that is constructed to store data and computer programs. The memory may store operating instructions to direct the operation of the processor when initiated thereby. The memory is a non-volatile memory and includes a threshold value section that is dedicated location of the memory configured to store threshold values.

The processor may be a conventional processor such as a microprocessor. The processor includes a comparison component (132) that compares the measured position and load sensor values to a threshold value. A signaling or actuation component (134) is configured to allow or actuate further operation of particular slips, depending on the comparison step.

Thus, in one embodiment, operation of the slips (i.e., opening and closing) is thus driven by pre-programmed thresholds of the respective physical quantities detected by the position sensors and load sensors. The control system may then signal the operator to actuate the slips, or may directly control the slip actuators in an automated method. In a semi-automated process, the actuation of the slips may be initiated by an operator, but the actuation may be blocked by the control system unless satisfactory position and load measurements are received by the system.

Figure 1B:
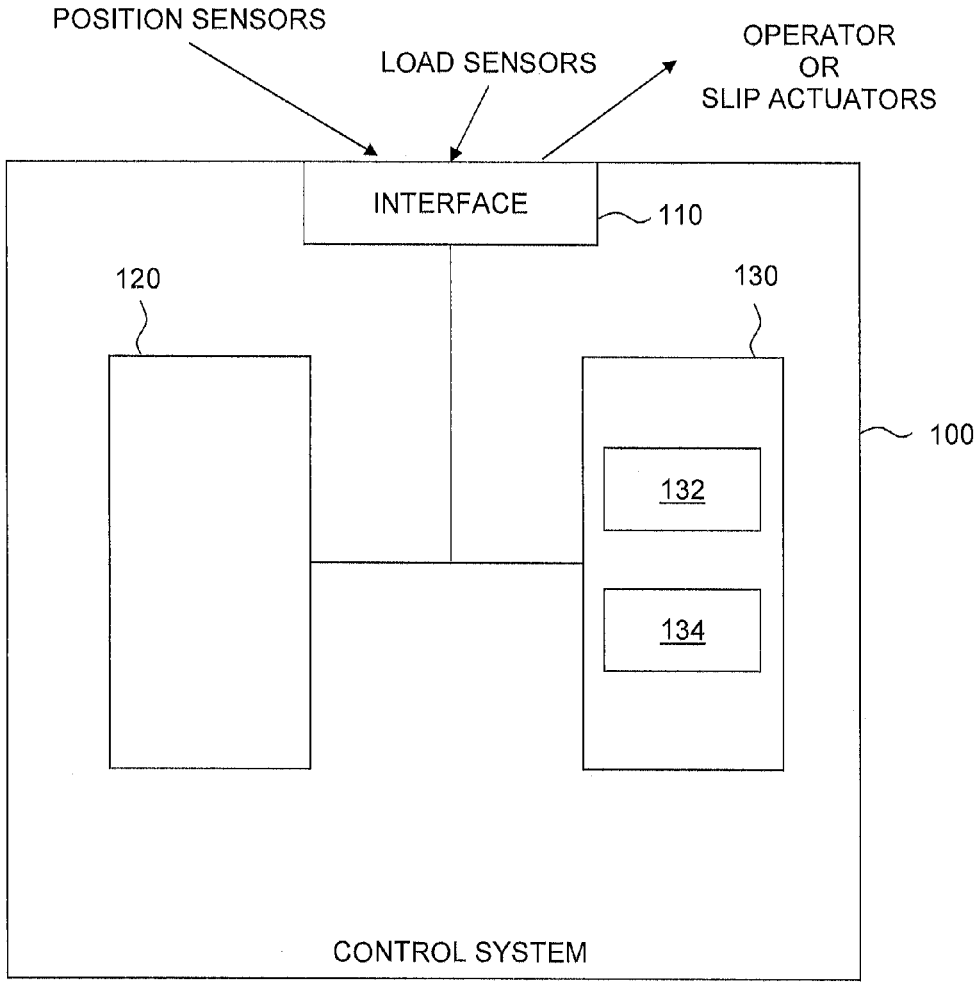
FIG. 1B is a schematic diagram of one embodiment of a system of the present invention.

In one embodiment, load sensors (34A-D) are positioned so as to be associated with each of the four sets of slips shown, for example, in FIG. 1. Suitable load sensors include, but are not limited to, an air bladder, a hydraulic bladder, an electronic load cell, a hydraulic load cell, a strain gauge, or other appropriate weight sensor. The load sensor may be incorporated assembled into the slips, or attached between the slips and the load bearing structure member to which the slips are mounted. When loaded, the load sensor will provide a measurable value of the compressive or tensile load applied to the slip. The value will be relayed to the control system.

If the load sensor is a fluid-filled bladder, then a pressure transducer within the bladder may measure the pressure and send the information to the control system.

Although the load on any given slip may exceed many tens of thousands of pounds in a snubbing operation, the load sensors need not quantify the load above a threshold value which is a substantial load. For example, any load over 5,000 lbs is a substantial load, indicative of a positive grip on the pipe by the slips. A substantial load may be any significant weight which is indicative of adequate slip engagement.

The position sensor may sense or detect the position of a slip either directly or indirectly. In one embodiment, the position sensor detects the physical position of a moving component of the slip, or a moving component of the actuator which opens or closes a particular set of slips, which may be a hydraulic cylinder and rod arrangement. The position of the moving component will be indicative of the position of the slip. Position sensors are well known in the art, and may include electronic proximity sensors, linear or rotary differential transformers, string potentiometers, or rotary or shaft encoders. In one embodiment, the position sensor determines the position of the rod in an actuating hydraulic cylinder arrangement.

In another embodiment, the position sensor may comprise a flow meter which measures the volume of hydraulic oil which was used to either extend or retract the hydraulic cylinder rods from or into their corresponding hydraulic cylinders. The volume required to open the slips is calibrated by opening the slips from the closed position. The volume is recorded for use in confirming that the slips have fully opened. The volume required to close the slips is calibrated by closing the slips from the open position and recorded for use in confirming that the slips have fully closed.

The volume required versus the position of the cylinder rod is a directly linear relationship. A volume measurement may thus be used to indirectly determine the position of the slips during closing and opening. For example, if the volume used to close the slips was 75% of the calibrated volume, then it may be inferred that the slip hydraulic cylinder rod moved only 75% of the distance required to fully close the slips on the pipe string. Such information provides the control system and/or operator with confirmation that the slips did not completely close as required.

In one embodiment, the system may further comprise a measurement system for measuring the movement of the hydraulic valves which fill or empty the hydraulic cylinders which actuate the slips. The hydraulic valves move into either an open position to allow the flow of pressurized hydraulic oil, or a closed position to prevent the flow of the hydraulic oil. The hydraulic oil in turn powers the hydraulic cylinders to open and close the slips. By measuring the opening or closing of the hydraulic valves, the control system may determine if the hydraulic valves have successfully completed the desired action, and are properly functioning.

In operation, the system monitors the slip position and load sensors to determine if a specific slip actuation has been completed successfully. If the sensors indicate that the required actions have been completed, the control system will emit a signal to operate, or allow operation of the opposing set of slips to which the load is being transferred. If the position sensors and/or load sensors do not generate successful (ie. pipe engagement) signals, then the control system will not release the opposing set of slips, or the operator is warned not to release the opposing set of slips.

The control system will provide the operator with confirmation that the load has been transferred to the slips which have been actuated. The operator will thus be aware that the slips have a sufficient hold on the pipe string, so as to be confident in releasing the opposing slips. The load and position sensors may also provide confirmation that previously loaded slips have released its hold on the pipe string, and thus has been relieved of its load.

The control system may have features for recording events or maintenance including, but not limited to, event logging with real time clock for data time stamping, and logging of system configuration changes to track the system configuration history and the identity of the operator performing the configuration changes. Display means which are either connected to or integral with the control system display indication signals (for example, system status, errors, alarms, output messages, instructions, audible buzzers) to inform an operator whether a particular slip is opened or closed.

The following is a specific example of one embodiment of the present invention. This example demonstrates how the system of the present invention can be used for monitoring and controlling slips of a snubbing unit to reduce the risk of dropping or ejecting the pipe string. This example is offered by way of illustration and is not intended to limit the claimed invention in any manner.

A method of the present invention may be implemented in the operation of any service unit, where load bearing components operating in a sequential manner for running pipe into or out of a well, comprising the steps of:

a) engaging the pipe with a first load bearing component and moving a second load bearing component to a first position;

(b) engaging the pipe with the second load bearing component;

(c) confirming with a position sensor or a load sensor, or both a position sensor and a load sensor, that the second load bearing component has adequately engaged the pipe before completely releasing the first load bearing component;

(d) moving the second load bearing component to a second position to move pipe either into or out of a wellbore.

Figure 2:
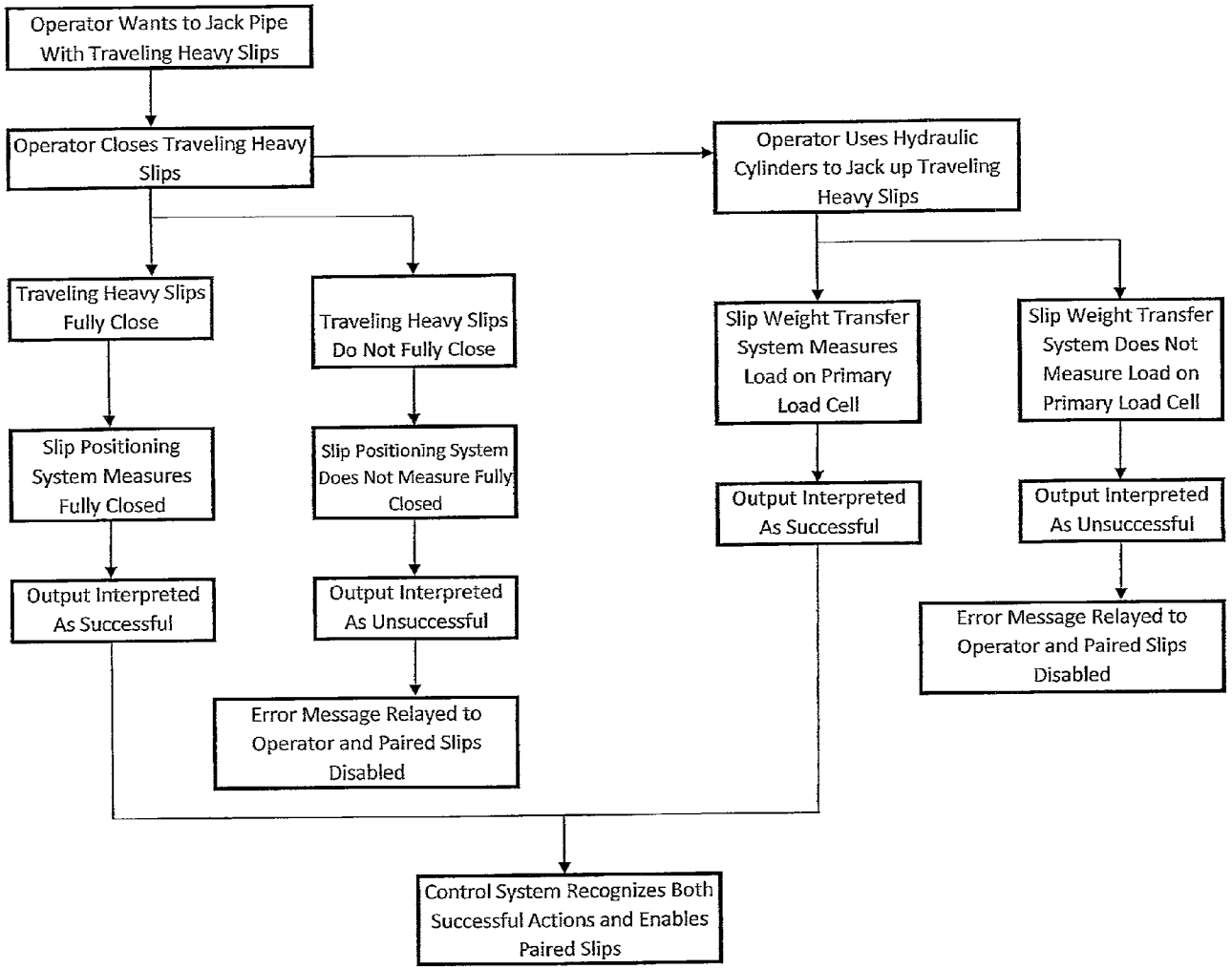
FIG. 2 is a schematic block diagram of the method of one embodiment of the present invention.

Exemplary steps are presented schematically in FIG. 2 for removing pipe string from the well, in a pipe heavy situation, by transferring the load from the stationary heavy slip to the traveling heavy slip. This may be achieved by the operator closing the traveling heavy slips on the pipe string by actuating the slip hydraulic cylinders. As the hydraulic cylinders move the cylinder rods downwardly, the positioning sensor detects and senses the movement, generates a signal representative of the position of the cylinder rod, and transmits the signal to the control system.

If the traveling heavy slips have not yet completely closed, the control system may provide a signal (for example, audible, visual or electronic) to the operator notifying of the incomplete action, and the paired slips may be disabled. If the traveling heavy slips have completely closed, the control system interprets the signal as a completed, successful action, and the paired slips may be enabled or actuated.

With the traveling heavy slips fully closed to restrain the pipe string, the operator may then begin to transfer the pipe string load from the stationary heavy slips to the traveling heavy slips, by moving the traveling heavy slips slightly upward. The load sensors associated with the traveling heavy slips will sense and detect the load, generate a signal representative of the load, and transmit the signal to the control system for processing and analysis. In one embodiment, if the load reaches a minimum threshold level, for example 5,000 pounds, the control system will interpret the signal as a completed, successful action. Before the load reaches the minimum threshold level, the control system will provide a signal to the operator, and may block release of the stationary slips.

If the traveling heavy slips are not loaded, the control system emits a signal to the operator notifying of the incomplete action, and may automatically prevent the stationary heavy slips from disengaging. If the traveling heavy slips are loaded, the control system interprets the signal as a completed, successful action.

If the signals from either or both of the positioning sensors and load sensors are not indicative of successful travelling slip engagement with the pipe, the control system will signal the operator accordingly, and may not permit disengagement of the stationary slips. Once the traveling heavy slips are both properly loaded and restraining the pipe string, the control system then signals the operator and permits actuation of the stationary heavy slips which can be released from the pipe string to allow its removal from the well.

Figure 3:
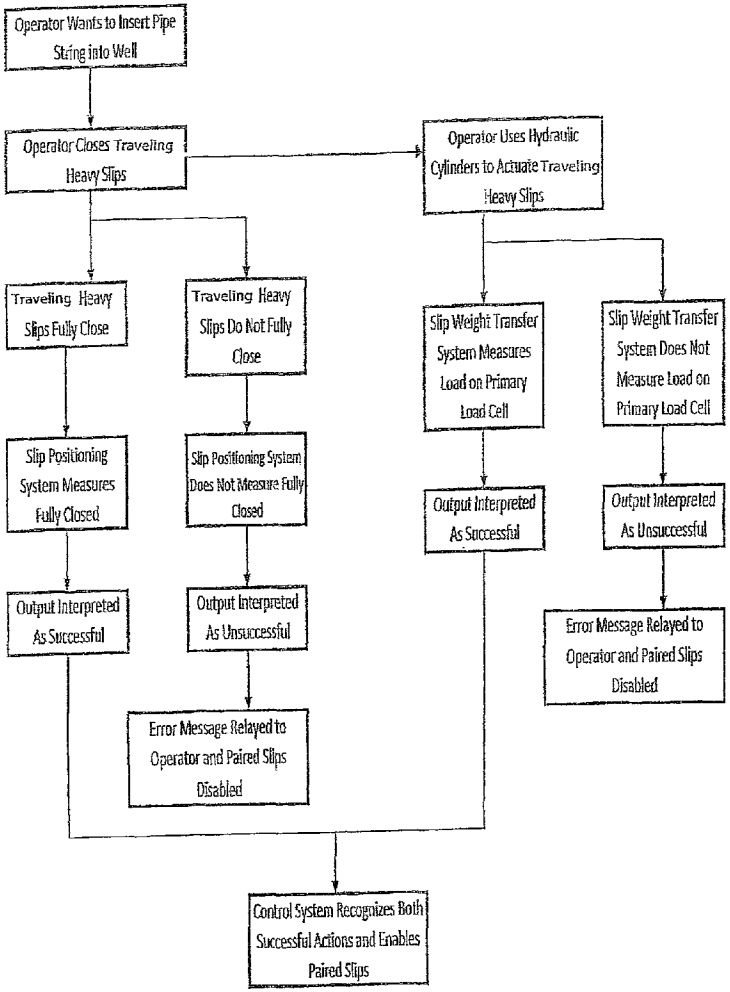
FIG. 3 is a schematic block diagram of the method of one embodiment of the present invention.

Exemplary steps are presented schematically in FIG. 3 for inserting the pipe string into the well, in a pipe light configuration, by transferring the load from the traveling snubbing slip to the stationary snubbing slip. Once the traveling snubbing slip has reached the bottom of its stroke, the operator then closes the stationary snubbing slips on the pipe string by actuating the hydraulic cylinders. As the hydraulic cylinders move the cylinder rods, the positioning sensor detects and senses the movement, generates a signal representative of the position of the cylinder rod, and transmits the signal to the control system for processing and analysis.

If the stationary snubbing slips have not completely closed, the control system emits a signal to the operator notifying of the incomplete action, and may automatically prevent the traveling snubbing slips from actuating. If the stationary snubbing slips have completely closed, the control system interprets the signal as a completed action.

With the stationary snubbing slips fully closed to restrain the pipe string, the operator may then begin to transfer the pipe string load from the traveling snubbing slips to the stationary snubbing slips, by moving the traveling snubbing slips slightly upward. The load sensors sense and detect the resulting load on the stationary snubbing slips, generate a signal representative of the load, and transmit the signal to the control system.

If the stationary snubbing slips are not sufficiently loaded, the control system emits a signal to the operator notifying of the incomplete action, and may automatically prevent the traveling snubbing slips from disengaging. If the stationary snubbing slips are loaded, the control system interprets the signal as a completed action.

If the signals from either or both of the positioning sensors and load sensors are not indicative of successful stationary slip engagement with the pipe, the control system will signal the operator accordingly, and may not permit disengagement of the travelling snubbing slips. Once the stationary snubbing slips are both properly loaded and restraining the pipe string, the control system then emits a signal to actuate the traveling snubbing slips which can be released from the pipe string to allow the hydraulic cylinders to jack up the traveling snubbing slips. The sensors and method of transferring the pipe from the stationary snubbing slips to the traveling snubbing slips is initiated and completed to allow the traveling snubbing slips to insert the pipe string into the well.

The functionality and features associated with the control system as described above and in accordance with the embodiments may be implemented in the form of one or more software objects, components, or computer programs or program modules in the server and/or the client machines. The control system and methods described above may be implemented in software, firmware or hardware, or combinations thereof. The system components shown in the Figures or described above may be or may include a computer or multiple computers. The components may be described in the general context of computer-executable instructions, such as program modules, being executed by a computer. Generally, program modules include routines, programs, objects, components, data structures, etc., that perform particular tasks or implement particular abstract data types. Further, at least some or all of the software objects, components or modules can be hard-coded into processing units, programmable devices, and/or read only memories or other non-volatile storage media. The specific implementation details of the software objects and/or program modules will be within the knowledge and understanding of one skilled in the art.

Thus, the control system may comprise a processing unit which operates under stored program control, for example, software or firmware stored in memory or other non-volatile storage media, may utilize any of a wide variety of other technologies including a special purpose computer, a micro-computer, mini-computer, mainframe computer, programmed microprocessor, micro-controller, peripheral integrated circuit element, a CSIC (Customer Specific Integrated Circuit), ASIC (Application Specific Integrated Circuit), a logic circuit, a digital signal processor, a programmable logic device such as an FPGA (Field Programmable Gate Array), PLD (Programmable Logic Device), PLA (Programmable Logic Array), RFID processor, smart chip, or any other device or arrangement of devices that is capable of implementing the steps of the processes of the invention.

The computer system may include a general purpose computing device in the form of a computer including a processing unit, a system memory, and a system bus that couples various system components including the system memory to the processing unit. Although many internal components of the computer or microprocessor device are not shown or described, those of ordinary skill in the art will appreciate that such components and the interconnections are well known.

As will be apparent to those skilled in the art, various modifications, adaptations and variations of the foregoing specific disclosure can be made without departing from the scope of the invention claimed herein.

What is claimed is:

1. A system for monitoring and controlling a service unit for snubbing a pipe, the service unit having stationary heavy slips and a travelling heavy slips operating in tandem to engage and move the pipe into or out of a well in a pipe heavy configuration, and a stationary snubbing slips and a travelling snubbing slips operating in tandem to engage and move the pipe into or out of the well in a pipe light configuration, the system comprising:

(a) a first actuation sensor associated with the stationary heavy slips, a second actuation sensor associated with the travelling heavy slips, a third actuation sensor associated with the stationary snubbing slips, and a fourth actuation sensor associated with the travelling snubbing slips, wherein the actuation sensors directly or indirectly detect engagement of the associated slips on the pipe; and (b) a control system operatively connected to the first, second, third and fourth actuation sensors and adapted to receive input signals from the sensors, and configured to execute a method comprising the step of:

when the pipe is in the pipe heavy configuration, confirming that one of the heavy slips has engaged the pipe, before fully releasing, or allowing the full release of the other one of the heavy slips, when transferring the pipe load from one of the heavy slips to the other one of the heavy slips; and when the pipe is in the pipe light configuration, confirming that one of the snubbing slips has engaged the pipe, before fully releasing, or allowing the full release of the other one of the snubbing slips, when transferring the pipe load from one of the snubbing slips to the other one of the snubbing slips.

2. The system of claim 1 wherein the method comprises the further step of:

when moving the pipe in the pipe heavy configuration, confirming that the previously loaded one of the heavy slips has fully released the pipe and has become unloaded; and when moving the pipe in the pipe light configuration, confirming that the previously loaded one of the snubbing slips has fully released the pipe and has become unloaded.

3. The system of claim 1, wherein any one of the actuation sensors comprises a position sensor for detecting a position of the associated slips.

4. The system of claim 3 wherein any one of the position sensors detects the position of a moving part of the associated slips or a moving part of a component which actuates the associated slips, which is indicative of the position of the associated slips.

5. The system of claim 4 wherein any one of the position sensors detects the position of a hydraulic cylinder rod which actuates the associated slips.

6. The system of claim 3, wherein any one of the position sensors comprises a flow meter for measuring volume of hydraulic fluid flowing into or out of a hydraulic cylinder which actuates the associated slips.

7. The system of claim 1, wherein any one of the actuation sensors comprises a load sensor for detecting a load on the associated slips.

8. The system of claim 7, wherein the load sensor comprises an air bladder, a hydraulic bladder, an electronic load cell, a hydraulic load cell, or a strain gauge.

9. The system of claim 8, wherein the load sensor comprises a pressure transducer.

10. The system of claim 1 wherein any one of the actuation sensors comprises both a position sensor and a load sensor.

11. The system of claim 1 wherein the control system further comprises a component which permits or blocks actuation of the travelling heavy slips or the travelling snubbing slips depending on the status of the stationary heavy slips or the stationary snubbing slips, respectively.

12. A method of running a pipe into or out of a well with a service unit for snubbing a pipe, the service unit having a stationary heavy slips and a travelling heavy slips operating in a sequential manner for engaging and moving the pipe into or out of the well in a pipe heavy configuration, and a stationary snubbing slips and a travelling snubbing slips operating in a sequential manner for engaging and moving the pipe into or out of the well in a pipe light configuration, the method comprising the steps of:

(a) when the pipe is in the pipe heavy configuration:

(i) engaging the pipe with the stationary heavy slips and moving the travelling heavy slips to a first position;

(ii) engaging the pipe with the travelling heavy slips;

(iii) confirming with a position sensor or a load sensor, or both a position sensor and a load sensor, associated with the travelling heavy slips that the travelling heavy slips has adequately engaged the pipe before completely releasing the stationary heavy slips; and (iv) moving the travelling heavy slips to a second position to move the pipe either into or out of a wellbore; and (b) when the pipe is in the pipe light configuration:

(i) engaging the pipe with the stationary snubbing slips and moving the travelling snubbing slips to a third position;

(ii) engaging the pipe with the travelling snubbing slips;

(iii) confirming with a position sensor or a load sensor, or both a position sensor and a load sensor, associated with the travelling snubbing slips that the travelling snubbing slips has adequately engaged the pipe before completely releasing the stationary snubbing slips; and (iv) moving the travelling snubbing slips to a fourth position to move the pipe either into or out of the wellbore.

13. The method of claim 12 wherein the confirmation step (a)(iii) comprises the step of determining whether or not the travelling heavy slips have reached a closed position engaging the pipe, or determining whether or not the travelling heavy slips are bearing a substantial load, or both.

14. The method of claim 13 wherein a control system prevents complete release of the one of the heavy slips unless it is confirmed that that the other one of the heavy slips have adequately engaged the pipe, or prevents complete release of one of the snubbing slips unless it is confirmed that the other one of the snubbing slips has adequately engaged the pipe.

* * * * *